US009494329B2

(12) United States Patent
Yasutomi

(10) Patent No.: US 9,494,329 B2
(45) **Date of Patent: *Nov. 15, 2016**

(54) AIR CONDITIONING INDOOR UNIT

(71) Applicant: DAIKIN INDUSTRIES, LTD., Osaka-shi, Osaka (JP)

(72) Inventor: Masanao Yasutomi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/367,117

(22) PCT Filed: Dec. 26, 2012

(86) PCT No.: PCT/JP2012/083587

§ 371 (c)(1),
(2) Date: Jun. 19, 2014

(87) PCT Pub. No.: WO2013/099914

PCT Pub. Date: Apr. 7, 2013

(65) Prior Publication Data

US 2014/0315482 A1 Oct. 23, 2014

(30) Foreign Application Priority Data

Dec. 28, 2011 (JP) ..... 2011-288531

(51) Int. Cl.
*F24F 7/007* (2006.01)
*F24F 1/00* (2011.01)
*F24F 11/00* (2006.01)

(52) U.S. Cl.
CPC ..... *F24F 7/007* (2013.01); *F24F 1/0011* (2013.01); *F24F 11/0078* (2013.01); *F24F 2001/0048* (2013.01); *F24F 2221/28* (2013.01)

(58) Field of Classification Search
USPC ..... 454/284
See application file for complete search history.

(56) References Cited

U.S. PATENT DOCUMENTS 4,350,472 A * 9/1982 Morimoto ..... 415/125
4,607,565 A * 8/1986 Sugawara et al. ..... 454/319

(Continued)

FOREIGN PATENT DOCUMENTS

JP 2003-232531 A 8/2003
JP 2004-361011 A 12/2004
JP 2007-051866 A * 1/2007
JP 2009-97755 A 5/2009

OTHER PUBLICATIONS

European Search Report of corresponding EP Application No. 12 86 2515.9 dated Nov. 17, 2014.

(Continued)

*Primary Examiner* — Gregory Huson
*Assistant Examiner* — Martha Becton
(74) *Attorney, Agent, or Firm* — Global IP Counselors

(57) ABSTRACT

An air conditioning indoor unit includes a casing having an air outlet, a horizontal blade that changes an up and down direction flow of outlet air, a Coanda blade to change the outlet air to a Coanda airflow along an undersurface of the Coanda blade, and a control unit. The control unit adjusts a relative angle between the Coanda blade and the horizontal blade to selectively use either of a first airflow state and a second airflow state. In the first airflow state, the control unit adjusts the relative angle to a predetermined angle in a first angular range to produce the Coanda airflow on substantially an entire region of the undersurface of the Coanda blade. In the second airflow state, the control unit adjusts the relative angle to a predetermined angle in a second angular range larger than the first angular range to not produce the Coanda airflow.

16 Claims, 10 Drawing Sheets

(56) References Cited

U.S. PATENT DOCUMENTS

| | | | | |
|---|---|---|---|---|
| 4,738,116 | A * | 4/1988 | Himeno et al. | 62/186 |
| 5,762,034 | A * | 6/1998 | Foss | 123/41.49 |
| 5,771,708 | A * | 6/1998 | Suzuki et al. | 62/285 |
| 2010/0026034 | A1* | 2/2010 | Storgato et al. | 296/70 |
| 2011/0010958 | A1* | 1/2011 | Clark et al. | 34/97 |
| 2012/0168117 | A1* | 7/2012 | Jairazbhoy et al. | 165/48.1 |
| 2013/0286673 | A1* | 10/2013 | Umlauft et al. | 362/470 |
| 2013/0303071 | A1* | 11/2013 | Seki | 454/155 |
| 2014/0134939 | A1* | 5/2014 | Kamada et al. | 454/309 |

OTHER PUBLICATIONS

International Preliminary Report of corresponding PCT Application No. PCT/JP2012/083587 dated Jul. 10, 2014.

International Search Report of corresponding PCT Application No. PCT/JP2012/083587.

* cited by examiner

AIR CONDITIONING INDOOR UNIT

CROSS-REFERENCE TO RELATED APPLICATIONS

This U.S. National stage application claims priority under 35 U.S.C. §119(a) to Japanese Patent Application No. 2011-288531, tiled in Japan on Dec. 28, 2011, the entire contents of which are hereby incorporated herein by reference.

TECHNICAL FIELD

The present invention relates to an air conditioning indoor unit that can utilize the Coanda effect to guide a flow of outlet air in a predetermined direction.

BACKGROUND ART

Conventionally, there have been air conditioning indoor units that can utilize the Coanda effect to guide a flow of outlet air in a predetermined direction.

For example, in the air conditioner disclosed in JP-A No. 2003-232531, a horizontal louver is disposed in the neighborhood of an air outlet and in the traveling path of outlet air. in this air conditioner, the outlet air becomes an upward Coanda airflow along the horizontal louver because of the Coanda effect and is guided toward a ceiling in a room.

SUMMARY

Technical Problem

In this connection, the present inventor investigated, in relation to an air conditioning indoor unit in which a Coanda blade and a horizontal blade cooperate with one another to utilize the Coanda effect to change outlet air to a Coanda airflow along an undersurface of the Coanda blade, the relationship between the Coanda airflow and the relative angle between the Coanda blade and the horizontal blade, and in doing so the present inventor discovered that as angular ranges of the relative angle between the Coanda blade and the horizontal blade, there exist an angular range in which the Coanda airflow is produced on substantially the entire region of the undersurface of the Coanda blade and an angular range in which the Coanda airflow is not produced and which is larger than the angular range in which the Coanda airflow is produced on substantially the entire region of the undersurface of the Coanda blade.

Therefore, it is an object of the present invention to produce, in an air conditioning indoor unit in which a Coanda blade and a horizontal blade cooperate with one another to change outlet air to a Coanda airflow along an undersurface of the Coanda blade, a stable airflow in both an airflow state utilizing the Coanda airflow and an airflow state not utilizing the Coanda airflow by adjusting the relative angle between the Coanda blade and the horizontal blade.

Solution to Problem

An air conditioning indoor unit pertaining to a first aspect of the present invention is equipped with a casing, a horizontal blade, a Coanda blade, and a control unit. An air outlet from which outlet air is blown out is formed in the casing. The horizontal blade changes an up and down direction flow of the outlet air. The Coanda blade cooperates with the horizontal blade to utilize the Coanda effect to change the outlet air to a Coanda airflow along an undersurface of the Coanda blade. The control unit can adjust a relative angle between the Coanda blade and the horizontal blade in such a way as to selectively use either of a first airflow state and a second airflow state. The first airflow state is a state in which the control unit adjusts the relative angle to a predetermined angle in a first angular range to produce the Coanda airflow on substantially the entire region of the undersurface of the Coanda blade. The second airflow state is a state in which the control unit adjusts the relative angle to a predetermined angle in a second angular range larger than the first angular range to not produce the Coanda airflow.

The present inventor investigated, in relation to an air conditioning indoor unit in which a Coanda blade and a horizontal blade cooperate with one another to utilize the Coanda effect to change outlet air into a Coanda airflow along an undersurface of the Coanda blade, the relationship between the Coanda airflow and the relative angle between the Coanda blade and the horizontal blade, and in doing so the present inventor discovered that as angular ranges of the relative angle between the Coanda blade and the horizontal blade, there exist a first angular range that results in a first airflow state in which the Coanda airflow is produced on substantially the entire region of the undersurface of the Coanda blade and a second angular range that is larger than the first angular range and results in a second airflow state in which the Coanda airflow is not produced.

Therefore, in the air conditioning indoor unit pertaining to the first aspect of the present invention, in the case of using the first airflow state, the relative angle between the Coanda blade and the horizontal blade is adjusted to a predetermined angle in the first angular range. Furthermore, in the case of using the second airflow state, the relative angle between the Coanda blade and the horizontal blade is adjusted to a predetermined angle in the second angular range. In this way, in this air conditioning indoor unit, by adjusting the relative angle between the Coanda blade and the horizontal blade to the predetermined angle in the first angular range or the second angular range, either of the first airflow state and the second airflow state can be selectively used.

Because of this, a stable airflow can be produced in both the first airflow state utilizing the Coanda airflow and the second airflow state not utilizing the Coanda airflow.

An air conditioning indoor unit pertaining to a second aspect of the present invention is the air conditioning indoor unit of the first aspect, wherein when the relative angle is adjusted to a predetermined angle in a third angular range, this results in a third airflow state in which the Coanda airflow is produced on part of the undersurface of the Coanda blade. Furthermore, the first angular range and the second angular range are set in such a way as to exclude the third angular range.

The present inventor discovered that as an angular range of the relative angle between the Coanda blade and the horizontal blade, there is a third angular range that results in an unstable third airflow state in which the Coanda airflow is produced on part of the undersurface of the Coanda blade.

Therefore, in the air conditioning indoor unit pertaining to the second aspect of the present invention, the first angular range and the second angular range are set in such a way as to exclude the third angular range that results in the third airflow state. For this reason, when the first airflow state and the second airflow state are used, the concern that this will result in an unstable airflow can be reduced.

Because of this, a stable airflow can be produced in both the first airflow state and the second airflow state.

An air conditioning indoor unit pertaining to a third aspect of the present invention is the air conditioning indoor unit of the second aspect, wherein an upper limit angle of the first angular range is set to an angle equal to or less than an angle at which there is a transition from the third airflow state to the first airflow state in a case where the relative angle has been gradually decreased from a predetermined angle in the second angular range. In this air conditioning indoor unit, the upper limit angle of the first angular range is set to an angle equal to or less than an angle at which there is a transition from the third airflow state to the first airflow state, so in a case where the first airflow state is used, the concern that this will result in an unstable airflow can be reduced, and as a result, a stable Coanda airflow can be produced.

An air conditioning indoor unit pertaining to a fourth aspect of the present invention is the air conditioning indoor unit of the second aspect or the third aspect, wherein a lower limit angle of the second angular range is set to an angle equal to or greater than an angle at which there is a transition from the third airflow state to the second airflow state in a case where the relative angle has been gradually increased from a predetermined angle in the first angular range. In this air conditioning indoor unit, the lower limit angle of the second angular range is set to an angle equal to or greater than an angle at which there is a transition from the third airflow state to the second airflow state, so in a case where the second airflow state is used, the concern that this will result in an unstable airflow can be reduced, and as a result, the concern that the Coanda airflow will be produced can be reduced.

An air conditioning indoor unit pertaining to a fifth aspect of the present invention is the air conditioning indoor unit of any of the second aspect to the fourth aspect, wherein an angle at which there is a transition from the first airflow state to the third airflow state in a case where the relative angle has been gradually increased from a predetermined angle in the first angular range and an angle at which there is a transition from the third airflow state to the first airflow state in a case where the relative angle has been gradually decreased from a predetermined angle in the third angular range are different. In this air conditioning indoor unit, the third angular range includes an angular range between the angle at which there is a transition from the first airflow state to the third airflow state in a case where the relative angle has been gradually increased from a predetermined angle in the first angular range and the angle at which there is a transition from the third airflow state to the first airflow state in a case where the relative angle has been gradually decreased from a predetermined angle in the third angular range. Additionally, because the first angular range is set in such a way as to exclude the third angular range, the angular range included in the third angular range is also excluded from the first angular range. Because of this, when the first airflow state is used, the concern that this will result in an unstable Coanda airflow can be reduced.

An air conditioning indoor unit pertaining to a sixth aspect of the present invention is the air conditioning indoor unit of any of the second aspect to the fifth aspect, wherein an angle at which there is a transition from the second airflow state to the third airflow state in a case where the relative angle has been gradually decreased from a predetermined angle in the second angular range and an angle at which there is a transition from the third airflow state to the second airflow state in a case where the relative angle has been gradually increased from a predetermined angle in the third angular range are different. In this air conditioning indoor unit, the third angular range includes an angular range between the angle at which there is a transition from the second airflow state to the third airflow state in a case where the relative angle has been gradually decreased from a predetermined angle in the second angular range and the angle at which there is a transition from the third airflow state to the second airflow state in a case where the relative angle has been gradually increased from a predetermined angle in the third angular range. Additionally, because the second angular range is set in such a way as to exclude the third angular range, the angular range included in the third angular range is also excluded from the second angular range. Because of this, when the second airflow state is used, the concern that this will result in an unstable Coanda airflow can be reduced.

An air conditioning indoor unit pertaining to a seventh aspect of the present invention is the air conditioning indoor unit of any of the first aspect to the sixth aspect and is further equipped with a fan that is disposed inside the casing and forms an airflow in which air taken into the casing is channeled toward the air outlet. Furthermore, the Coanda airflow is produced as a result of the outlet air being regulated by a regulating surface of the horizontal blade and thereafter flowing along the undersurface of the Coanda blade. Moreover, the casing includes a scroll surface that ranges from a back side of the fan to the air outlet and forms a lower portion of a flow path for the outlet air. Additionally, in a case where the first airflow state is used, the regulating surface of the horizontal blade is set in such a way as to be in a position on an upper side of an imaginary extension plane of the scroll surface.

In an air conditioning indoor unit having a configuration that uses the regulating surface of the horizontal blade to regulate the outlet air and thereafter channel the outlet air toward the undersurface of the Coanda blade to change the outlet air to a Coanda airflow along the undersurface of the Coanda blade, in a case where the regulating surface of the horizontal blade is positioned on the lower side of the imaginary extension plane of the scroll surface, depending on the structure of the scroll surface, sometimes the outlet air cannot be regulated toward the undersurface of the Coanda blade.

Therefore, in the air conditioning indoor unit pertaining to the seventh aspect of the present invention, in a case where the first airflow state is used, by setting the position of the regulating surface of the horizontal blade on the upper side of the imaginary extension plane of the scroll surface, the outlet air can be regulated by the regulating surface of the horizontal blade toward the undersurface of the Coanda blade. For this reason, in a case where the first airflow state is used, the concern that the Coanda airflow will not be produced can be reduced.

Advantageous Effects of Invention

In the air conditioning indoor unit pertaining to the first aspect of the present invention, by adjusting the relative angle between the Coanda blade and the horizontal blade to a predetermined angle in the first angular range or the second angular range, a stable airflow can be produced in both the first airflow state utilizing the Coanda airflow and the second airflow state not utilizing the Coanda airflow.

In the air conditioning indoor unit pertaining to the second aspect of the present invention, the first angular range and the second angular range are set in such a way as to exclude the third angular range, so a stable airflow can be produced in both the first airflow state and the second airflow state.

In the air conditioning indoor unit pertaining to the third aspect of the present invention, the upper limit angle of the first angular range is set to an angle equal to or less than the angle at which there is a transition from the third airflow state to the first airflow state, so in a case where the first airflow state is used, a stable Coanda airflow can be produced.

In the air conditioning indoor unit pertaining to the fourth aspect of the present invention, the lower limit angle of the second angular range is set to an angle equal to or greater than the angle at which there is a transition from the third airflow state to the second airflow state, so in a case where the second airflow state is used, the concern that the Coanda airflow will be produced can be reduced.

In the air conditioning indoor unit pertaining to the fifth aspect of the present invention, the angular range included in the third angular range is excluded from the first angular range, so when the first airflow state is being used, the concern that this will result in an unstable Coanda airflow can be reduced.

In the air conditioning indoor unit pertaining to the sixth aspect of the present invention, the angular range included in the third angular range is excluded from the second angular range, so when the second airflow state is being used, the concern that this will result in an unstable Coanda airflow can be reduced.

In the air conditioning indoor unit pertaining to the seventh aspect of the present invention, in a case where the first airflow state is used, the position of the regulating surface of the horizontal blade is set on the upper side of the imaginary extension plane of the scroll surface, so that when the first airflow state is used, the concern that the Coanda airflow will not be produced can be reduced.

DESCRIPTION OF EMBODIMENT

An embodiment of the present invention will be described below with reference to the drawings. The embodiment below is a specific example of the present invention and is not intended to limit the technical scope of the present invention.

(1) Configuration of Air Conditioning Indoor Unit

Figure 1:
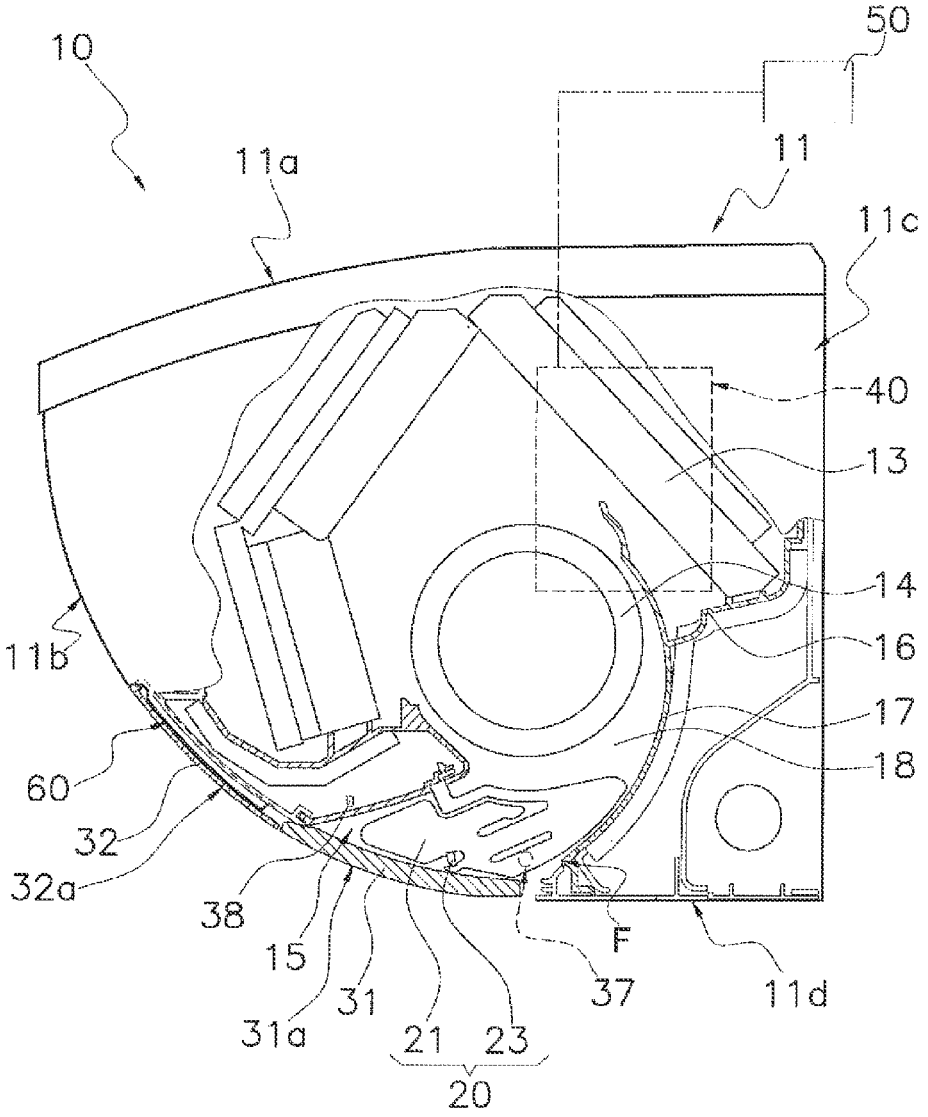
FIG. 1 is a cross-sectional view of an air conditioning indoor unit pertaining to an embodiment of the present invention when operation is stopped.
Figure 2:
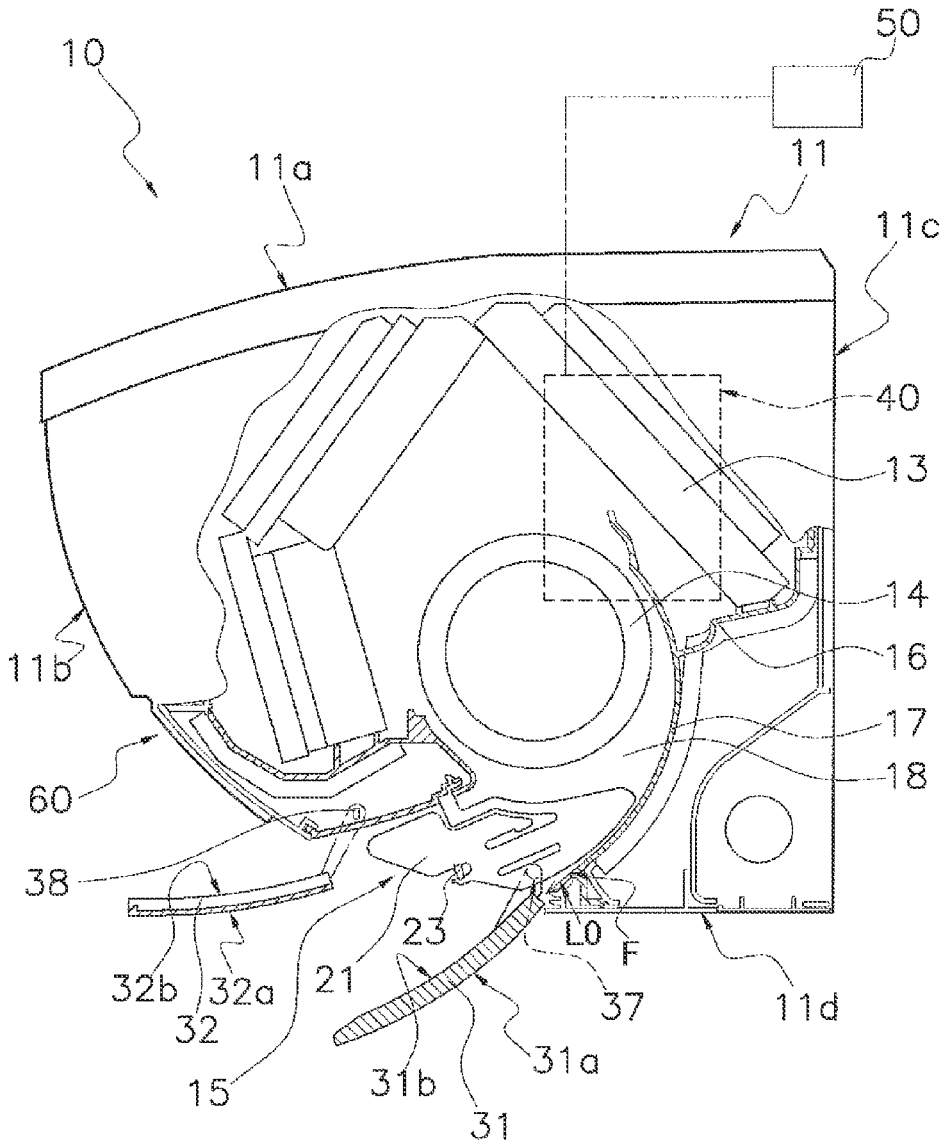
FIG. 2 is a cross-sectional view of the air conditioning indoor unit during operation.
Figure 3:
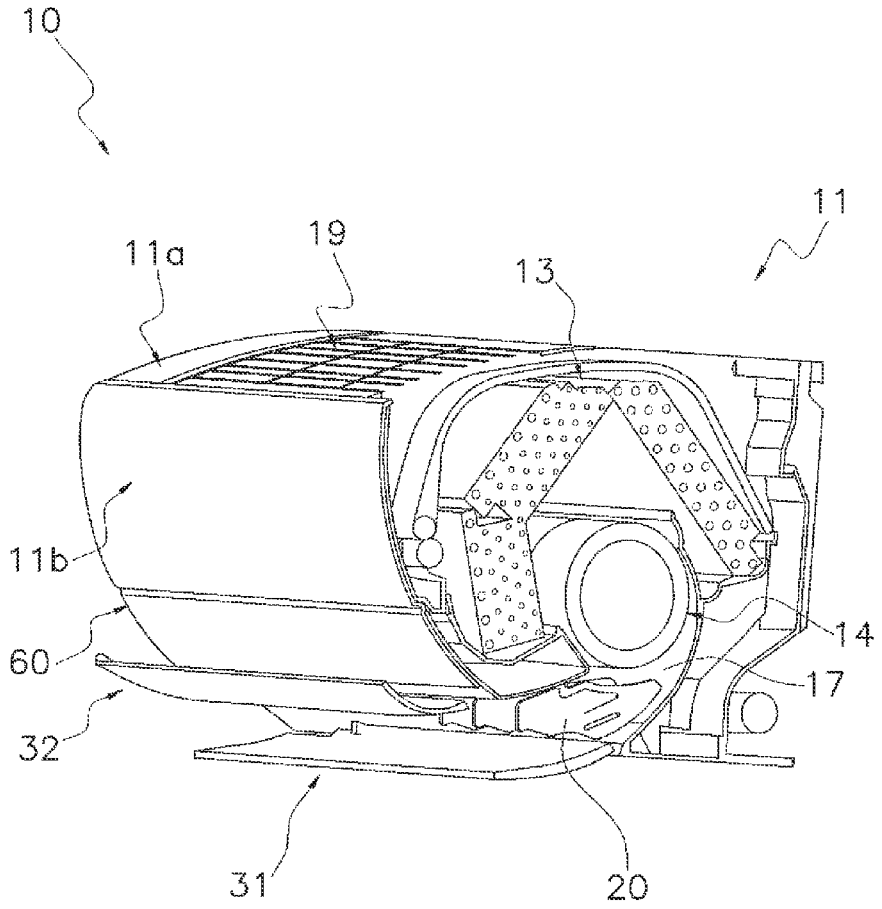
FIG. 3 is a cross-sectional view of the air conditioning indoor unit during operation.

FIG. 1 is a cross-sectional view of an air conditioning indoor unit 10 pertaining to a first embodiment of the present invention when operation is stopped. FIG. 2 is a cross-sectional view of the air conditioning indoor unit 10 during execution of a Coanda airflow utilization mode. FIG. 3 is a cross-sectional view of the air conditioning indoor unit 10 during execution of the Coanda airflow utilization mode as seen from an oblique direction.

The air conditioning indoor unit 10 is a wall-mounted air conditioning indoor unit attached to a wall surface in a room and is equipped with a body casing 11, an indoor heat exchanger 13, an indoor fan 14, a bottom frame 16, and a control unit 40.

The body casing 11 has a top surface portion 11*a*, a front surface panel 11*b*, a back surface plate 11*c*, and a lower portion horizontal plate 11*d* and houses the indoor heat exchanger 13, the indoor fan 14, the bottom frame 16, and the control unit 40 inside.

The top surface portion 11*a* is positioned on the upper portion of the body casing 11, and an air inlet 19 is disposed in the front portion of the top surface portion 11*a*.

The front surface panel 11*b* configures the front surface portion of the air conditioning indoor unit 10 and has a flat shape not having the air inlet 19. Furthermore, the upper end of the front surface panel 11*b* is rotatably supported on the top surface portion 11*a*, so that the front surface panel 11*b* can move in a hinged manner.

The indoor heat exchanger 13 and the indoor fan 14 are attached to the bottom frame 16. The indoor heat exchanger 13 performs heat exchange with air passing through it. Furthermore, the indoor heat exchanger 13 has an inverted V shape in which both ends bend downward as seen in a side view, and the indoor fan 14 is positioned under the indoor heat exchanger 13. The indoor fan 14 is a cross flow fan, causes air taken in from the room to be applied to and pass through the indoor heat exchanger 13, and blows out the air into the room.

An air outlet 15 is disposed in the lower portion of the body casing 11. A horizontal blade 31 that changes an up and down direction flow of outlet air blown out from the air outlet 15 is rotatably attached in the air outlet 15. The horizontal blade 31 is driven by a motor (not shown in the drawings) and not only changes the up and down direction flow of the outlet air but can also open and close the air outlet 15. Furthermore, the horizontal blade 31 can assume plural postures of which angles of inclination are different.

Furthermore, a Coanda blade 32 is disposed in the neighborhood of the air outlet 15 and above the horizontal blade 31. The Coanda blade 32 is driven by a motor (not shown in the drawings) and can assume plural postures of which angles of inclination are different. When operation is stopped, the Coanda blade 32 is housed in a housing portion 60 disposed in the front surface panel 11*b*.

Moreover, the air outlet 15 is connected to the inside of the body casing 11 by an outlet air flow path 18. The outlet air flow path 18 is formed from the air outlet 15 along a scroll surface 17 of the bottom frame 16.

The room air is sucked by the operation of the indoor fan 14 into the indoor fan 14 via the air inlet 19 and the indoor heat exchanger 13, travels from the indoor fan 14 through the outlet air flow path 18, and is blown out from the air outlet 15.

The control unit 40 is positioned on the right side of the indoor heat exchanger 13 and the indoor fan 14 when the body casing 11 is seen from the front surface panel 11*b* and controls the rotational speed of the indoor fan 14 and the movement of the horizontal blade 31 and the Coanda blade 32. Furthermore, the control unit 40 independently drives the horizontal blade 31 and the Coanda blade 32.

(2) Detailed Configuration (2-1) Front Surface Panel

As shown in FIG. 1, the front surface panel 11*b* extends from the front of the upper portion of the body casing 11 toward the front edge of the lower portion horizontal plate 11*d* while describing a gentle, circular arcuate curved surface. In the lower portion of the front surface panel 11*b*, there is a region that is recessed toward the inside of the body casing 11. The recessed depth of this region is set in such a way as to match the thickness dimension of the Coanda blade 32 to thereby form the housing portion 60 in which the Coanda blade 32 is housed. The surface of the housing portion 60 is also a gentle, circular arcuate curved surface.

(2-2) Air Outlet

As shown in FIG. 1, the air outlet 15 is formed in the lower portion of the body casing 11 and is a rectangular opening of which long edges lie along the lengthwise direction of the body casing 11. The lower end portion (rear end portion) of the air outlet 15 is adjacent to the front edge of the lower portion horizontal plate 11*d*, and an imaginary plane joining the lower end portion (rear end portion) and the upper end portion (front end portion) of the air outlet 15 is inclined forward and upward.

(2-3) Scroll Surface

The scroll surface 17 is a partition wall curved in such a way as to oppose the indoor fan 14 and is a part of the bottom frame 16. Furthermore, the scroll surface 17 forms the lower portion of the outlet air flow path 18, and a terminal end F of the scroll surface 17 reaches as far as the neighborhood of the peripheral edge of the air outlet 15. The air traveling through the outlet air flow path 18 proceeds along the scroll surface 17 and is sent in a direction tangential to the terminal end F of the scroll surface 17. Consequently, if the horizontal blade 31 were not in the air outlet 15, the direction in which the outlet air blown out from the air outlet 15 heads would be a direction generally along a tangent L0 to the terminal end F of the scroll surface 17 (see FIG. 2).

(2-4) Vertical Blades

Vertical blades 20 each have plural blade pieces 21 and a coupling rod 23 that couples together the plural blade pieces 21 (see FIG. 1 and FIG. 2). Furthermore, the vertical blades 20 are disposed further in the neighborhood of the indoor fan 14 than the horizontal blade 31 in the outlet air flow path 18.

When the coupling rods 23 reciprocate horizontally along the lengthwise direction of the air outlet 15, the plural blade pieces 21 swing right and left about a state perpendicular to that lengthwise direction. The coupling rods 23 are horizontally reciprocated by motors (not shown in the drawings).

(2-5) Horizontal Blade

The horizontal blade 31 is a plate-like member that is long in the lengthwise direction of the air conditioning indoor unit 10, and the horizontal blade 31 has an area of an extent that it can close the air outlet 15. An outside surface 31*a* of the horizontal blade 31 is finished to a gentle, circular arcuate curved surface that is outwardly convex in such a way as to lie on an extension of the curved surface of the front surface panel 11*b* in a state in which the horizontal blade 31 has closed the air outlet 15. Furthermore, an inside surface 31*b* of the horizontal blade 31 is also a circular arcuate curved surface substantially parallel to the outside surface 31*a*. In the present embodiment, the inside surface 31*b* of the horizontal blade 31 is a circular arcuate curved surface, but the inside surface of the horizontal blade may also be a flat surface.

The horizontal blade 31 has a rotating shaft 37 on its lower end portion (rear end portion). The rotating shaft 37 is coupled to a rotating shaft of a stepping motor (not shown in the drawings) fixed to the body casing 11 in the neighborhood of the lower end portion (rear end portion) of the air outlet 15.

When the rotating shaft 37 rotates in a counter-clockwise direction looking straight at FIG. 1, the upper end portion (front end portion) of the horizontal blade 31 moves away from the upper end portion (front end portion) side of the air outlet 15 and opens the air outlet 15. Conversely, when the rotating shaft 37 rotates in a clockwise direction looking straight at FIG. 1, the upper end portion (front end portion) of the horizontal blade 31 moves closer to the upper end portion (front end portion) side of the air outlet 15 and closes the air outlet 15.

In a state in which the horizontal blade 31 is opening the air outlet 15, the outlet air blown out from the air outlet 15 flows generally along the inside surface 31*b* of the horizontal blade 31. For this reason, in a case where the inside surface 31*b* of the horizontal blade 31 is on the upper side of the tangent L0 to the terminal end F of the scroll surface 17, the outlet air blown out generally along the direction tangential to the terminal end F of the scroll surface 17 has its air direction changed upward by the horizontal blade 31.

(2-6) Coanda Blade

The Coanda blade 32 is a plate-like member that is long in the lengthwise direction of the air conditioning indoor unit 10. In the present embodiment, the Coanda blade 32 is designed in such a way that the lengthwise direction dimension of the Coanda blade 32 is equal to or greater than the lengthwise direction dimension of the horizontal blade 31.

Furthermore, an outside surface 32*a* of the Coanda blade 32 is finished to a gentle, circular arcuate curved surface that is outwardly convex in such a way as to lie on an extension of the gentle, circular arcuate curved surface of the front surface panel 11*b* in a state in which the Coanda blade 32 is housed in the housing portion 60. Moreover, an inside surface 32*b* of the Coanda blade 32 is finished to a circular arcuate curved surface that follows the surface of the housing portion 60. In the present embodiment, the outside surface 32*a* of the Coanda blade 32 is a circular arcuate curved surface, but the outside surface 32*a* of the Coanda blade 32 may also be a flat surface.

Furthermore, the Coanda blade 32 is housed in the housing portion 60 in a case where air conditioning operations of the air conditioning indoor unit 10 are stopped and in a case where the air conditioning indoor unit 10 is operating in a normal blowing mode described later.

Additionally, the Coanda blade 32 moves away from the housing portion 60 by rotating and assumes postures in which it is inclined in the front and rear direction. A rotating shaft 38 of the Coanda blade 32 is disposed in the neighborhood of the lower end of the housing portion 60 and in a position inside the body casing 11 (a position above an upper wall of the outlet air flow path 18), and the lower end portion of the Coanda blade 32 and the rotating shaft 38 are coupled together while maintaining a predetermined distance between them. Thus, as the rotating shaft 38 rotates so that the upper end portion of the Coanda blade 32 moves away from the housing portion 60 of the front surface panel 11*b*, the height position of the lower end portion of the Coanda blade 32 becomes lower. Furthermore, the inclination of the Coanda blade 32 when it has rotated open is gentler than the inclination of the front surface panel 11*b*.

Moreover, when the rotating shaft 38 rotates in a counterclockwise direction looking straight at FIG. 1, both the upper end portion and the lower end portion of the Coanda blade 32 move away from the housing portion 60 while describing a circular arc, and at this time, the shortest distance between the upper end portion of the Coanda blade 32 and the housing portion 60 is greater than the shortest distance between the lower end portion of the Coanda blade 32 and the housing portion 60. Additionally, when the rotating shaft 38 rotates in a clockwise direction looking straight at FIG. 1, the Coanda blade 32 moves closer to the housing portion 60 and eventually is housed in the housing portion 60.

Figure 4A:
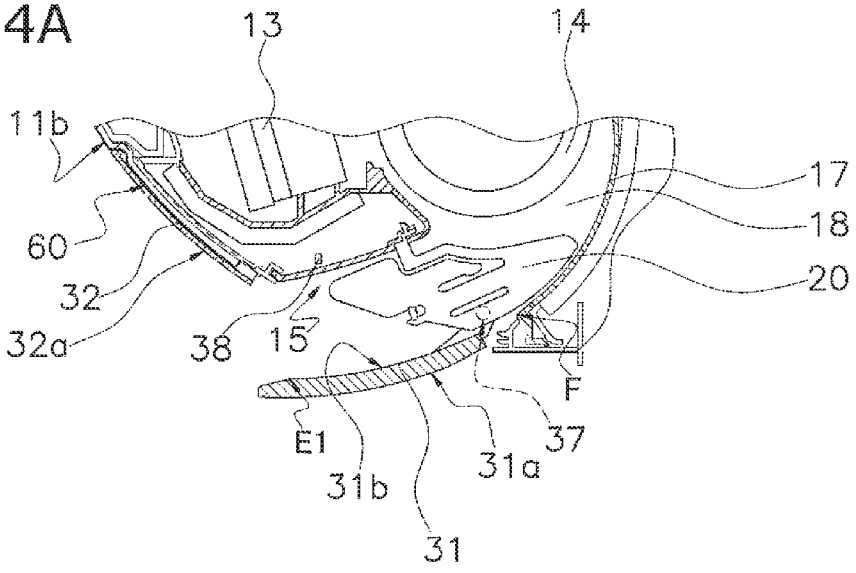
FIG. 4A is a partial cross-sectional view of the neighborhood of an air outlet during normal forward blowing of the outlet air.
Figure 4B:
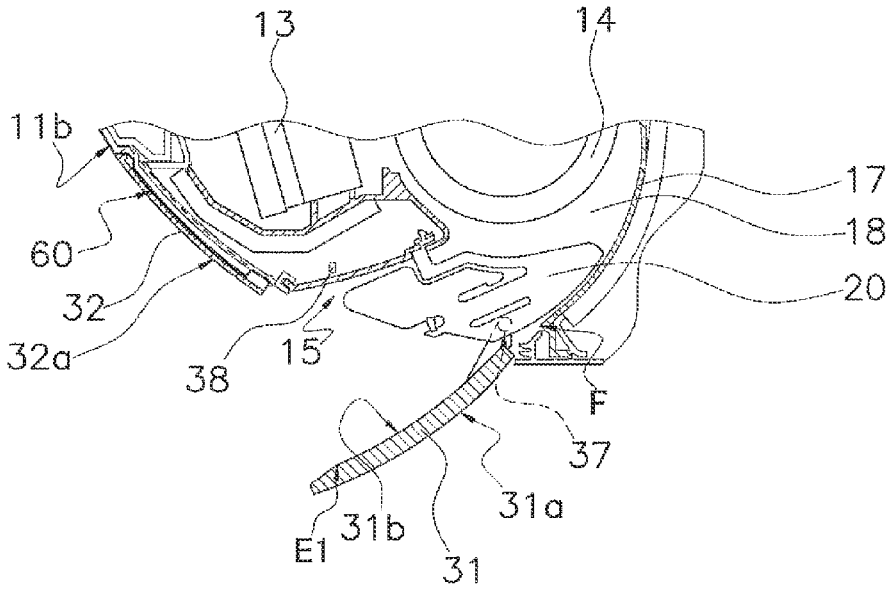
FIG. 4B is a partial cross-sectional view of the neighborhood of the air outlet during normal forward and downward blowing of the outlet air.
Figure 4C:
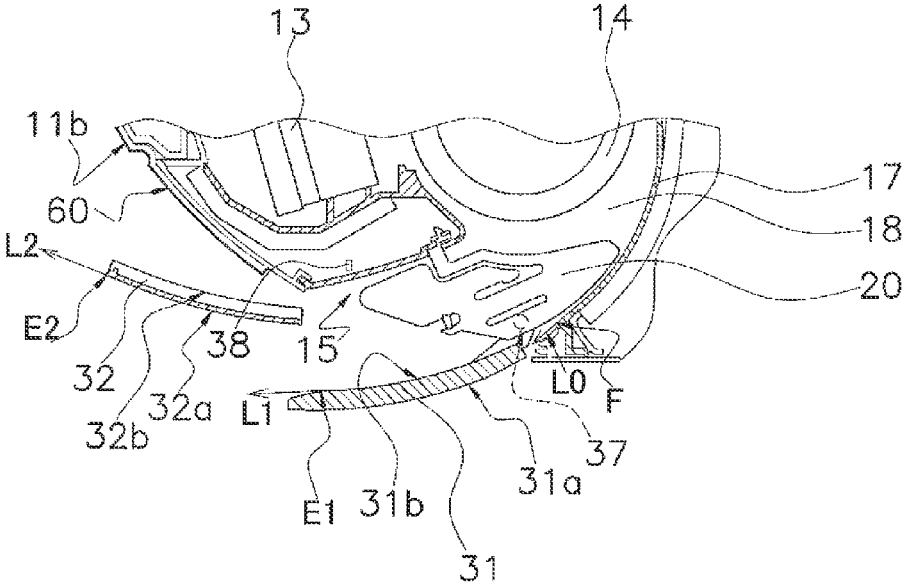
FIG. 4C is a partial cross-sectional view of the neighborhood of the air outlet during Coanda airflow ceiling blowing of the outlet air.
Figure 4D:
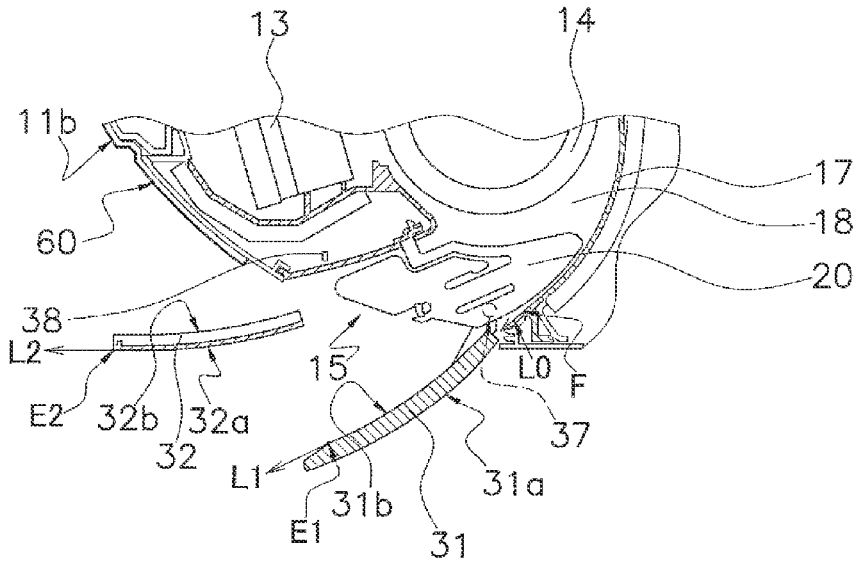
FIG. 4D is a partial cross-sectional view of the neighborhood of the air outlet during Coanda airflow forward blowing of the outlet air.
Figure 4E:
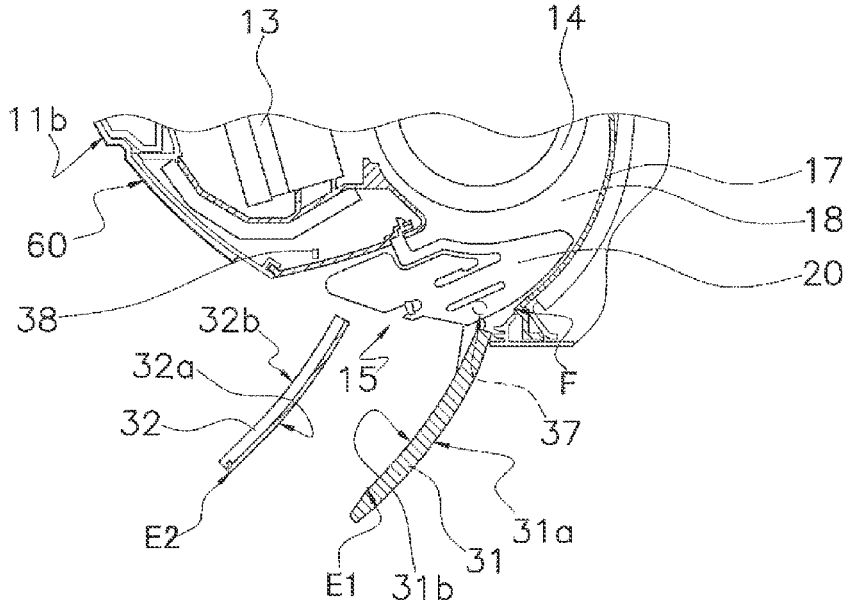
FIG. 4E is a partial cross-sectional view of the neighborhood of the air outlet during downward blowing of the outlet air.

The postures of the Coanda blade 32 include, for example, a posture in which the Coanda blade 32 is housed in the housing portion 60 as shown in FIG. 4A and FIG. 4B, a posture in which the Coanda blade 32 rotates to become inclined forward and upward as shown in FIG. 4C, a posture in which the Coanda blade 32 further rotates to become substantially horizontal as shown in FIG. 4D, and a posture in which the Coanda blade 32 further rotates to become inclined forward and downward as shown in FIG. 4E.

(3) Directional Control of Outlet Air

The air conditioning indoor unit 10 has, as means of controlling the direction of the outlet air, a normal blowing mode in which only the horizontal blade 31 is rotated to adjust the direction of the outlet air, a Coanda airflow utilization mode in which the horizontal blade 31 and the Coanda blade 32 are rotated to adjust the direction of the outlet air, and a downward blowing mode in which the front end of the horizontal blade 31 and the front end of the Coanda blade 32 are pointed forward and downward to guide the outlet air downward.

The postures of the horizontal blade 31 and the Coanda blade 32 change in each mode with each direction in which the air is blown out. The postures of the horizontal blade 31 and the Coanda blade 32 in each mode are stored in a storage unit (not shown in the drawings) that the control unit 40 has. Control of the outlet air in each mode is realized as a result of the control unit 40 adjusting the postures of the Coanda blade 32 and the horizontal blade 31. Furthermore, the postures of the horizontal blade 31 and the Coanda blade 32 employed in the normal blowing mode and the Coanda airflow utilization mode will be described in detail later.

Furthermore, the user can select the blowing direction via a remote controller 50 or the like. Moreover, it is also possible for the changing of the modes and the blowing direction to be controlled in such a way that they are automatically changed.

(3-1) Normal Blowing Mode

The normal blowing mode is a mode in which only the horizontal blade 31 is rotated to adjust the direction of the outlet air without changing the outlet air to a Coanda airflow along the outside surface 32*a* of the Coanda blade 32. As examples of the normal blowing mode, "normal forward blowing" and "normal forward and downward blowing" will be described below.

When the user has selected the "normal forward blowing," the control unit 40 rotates the horizontal blade 31 to a position in which the inside surface 31*b* of the horizontal blade 31 becomes substantially horizontal (see FIG. 4A). As a result, the outlet air becomes an airflow blown forward along the inside surface 31*b* of the horizontal blade 31.

Furthermore, when the user wants to change the blowing direction so that it is more downward than in the "normal forward blowing," the user selects the "normal forward and downward blowing." At this time, the control unit 40 rotates the horizontal blade 31 until the front part of the inside surface 31*b* of the horizontal blade 31 becomes lower than horizontal (see FIG. 4B). As a result, the outlet air becomes a forward and downward airflow along the inside surface 31*b* of the horizontal blade 31.

(3-2) Coanda Airflow Utilization Mode

Coanda (effect) is a phenomenon where, if there is a wall near a flow of gas or liquid, the gas or liquid tends to flow in a direction along the wall surface even if the direction of the flow and the direction of the wall are different (Hōsoku no jiten, Asakura Publishing Co., Ltd.). Additionally, the Coanda airflow utilization mode is a mode utilizing this Coanda effect, and is a mode in which the horizontal blade 31 and the Coanda blade 32 are rotated to utilize the Coanda effect to change the outlet air to a Coanda airflow along the outside surface 32*a* of the Coanda blade 32. As examples of the Coanda airflow utilization mode, "Coanda airflow ceiling blowing" and "Coanda airflow forward blowing" will be described below.

When the "Coanda airflow ceiling blowing" has been selected by the user, the control unit 40 rotates the horizontal blade 31 until the inside surface 31*b* of the horizontal blade 31 becomes substantially horizontal. Next, the control unit 40 rotates the Coanda blade 32 until the outside surface 32*a* of the Coanda blade 32 points forward and upward. Because of this, the outlet air adjusted by the horizontal blade 31 so as to be blown horizontally becomes an airflow attached to the outside surface 32*a* of the Coanda blade 32 because of the Coanda effect and changes to a Coanda airflow along the outside surface 32*a*.

Consequently, as shown in FIG. 4C, even when the direction of a tangent L1 to a front end E1 of the horizontal blade 31 is such as to result in forward blowing, the direction of a tangent L2 to a front end E2 of the Coanda blade 32 is such as to result in forward and upward blowing, so the outlet air is blown out in the direction of the tangent L2 to the front end E2 of the outside surface 32*a* of the Coanda blade 32—that is, in the direction of the ceiling—because of the Coanda effect.

Furthermore, when the "Coanda airflow forward blowing" has been selected by the user, the control unit 40 rotates the horizontal blade 31 until the front part of the inside surface 31*b* of the horizontal blade 31 becomes lower than horizontal. Next, the control unit 40 rotates the Coanda blade 32 to a position in which the outside surface 32*a* of the Coanda blade 32 becomes substantially horizontal. Because of this, the outlet air adjusted by the horizontal blade 31 so as to be blown forward and downward becomes an airflow attached to the outside surface 32*a* of the Coanda blade 32 because of the Coanda effect and changes to a Coanda airflow along the outside surface 32*a*.

Consequently, as shown in FIG. 4D, even when the direction of the tangent L1 to the front end E1 of the horizontal blade 31 is such as to result in forward and downward blowing, the direction of the tangent L2 to the front end E2 of the Coanda blade 32 is horizontal, so the outlet air is blown out in the direction of the tangent L2 to the front end E2 of the outside surface 32*a* of the Coanda blade 32—that is, in the horizontal direction—because of the Coanda effect.

(3-3) Downward Blowing Mode

When the "downward blowing" has been selected by the user, the control unit 40 rotates the horizontal blade 31 until the inside surface 31*b* of the horizontal blade 31 points downward (see FIG. 4E). Next, the control unit 40 rotates the Coanda blade 32 until the outside surface 32*a* of the Coanda blade 32 points downward (see FIG. 4E). As a result, the outlet air passes between the horizontal blade 31 and the Coanda blade 32 and is blown out downward.

In particular, even when the horizontal blade 31 is positioned in an angle that points more downward than the tangent L0 to the terminal end F of the scroll surface 17, a downward airflow can be produced by applying to the outside surface 32*a* of the Coanda blade 32 as a result of the control unit 40 executing the downward blowing mode.

(4) Postures of Coanda Blade and Horizontal Blade

The postures of the Coanda blade 32 and the horizontal blade 31 employed in the normal blowing mode and the Coanda airflow utilization mode will be described below.

Here, in a case where the Coanda blade 32 and the horizontal blade 31 cooperate with one another to change the outlet air to a Coanda airflow along the outside surface 32*a* of the Coanda blade 32 like in the air conditioning indoor unit 10 pertaining to the present embodiment, in order to produce the Coanda effect on the outside surface 32*a* of the Coanda blade 32, it is necessary for the inclination of the direction of the outlet air changed by the inside surface 31*b* of the horizontal blade 31 to become closer to the posture (inclination) of the Coanda blade 32. Additionally, if both are too far away from one another, the Coanda effect will not be produced on the Coanda blade 32.

For this reason, in order to change the outlet air to a Coanda airflow along the outside surface 32*a* of the Coanda blade 32, it is necessary to set the open angle formed by the Coanda blade 32 and the horizontal blade 31 to an angle equal to or less than a predetermined angle, that is, to set the relative angle between the Coanda blade 32 and the horizontal blade 31 to an angle equal to or less than the predetermined angle. Additionally, by setting the relative angle between the Coanda blade 32 and the horizontal blade 31 to an angle equal to or less than the predetermined angle, the outlet air can be changed to a Coanda airflow along the outside surface 32*a* of the Coanda blade 32. As a result, the air direction of the outlet air is changed by the horizontal blade 31 and is thereafter further changed by the Coanda effect.

From this, the present inventor thought that by defining the angular range of the relative angle between the Coanda blade 32 and the horizontal blade 31 at which the Coanda airflow is produced and the angular range of the relative angle between the Coanda blade 32 and the horizontal blade 31 at which the Coanda airflow is not produced and causing the Coanda blade 32 and the horizontal blade 31 to assume predetermined postures in which the relative angle between the Coanda blade 32 and the horizontal blade 31 becomes a predetermined angle belonging to each angular range, it would be possible to produce a stable airflow in both an airflow state utilizing the Coanda airflow and an airflow state not utilizing the Coanda airflow.

Therefore, the present inventor investigated the relationship between the Coanda airflow and the relative angle between the Coanda blade 32 and the horizontal blade 31 using various blade angle combinations of the Coanda blade 32 and the horizontal blade 31. The results of an evaluation test in regard to the relationship between the Coanda airflow and the relative angle between the Coanda blade 32 and the horizontal blade 31 will be described below using the drawings.

Figure 5:
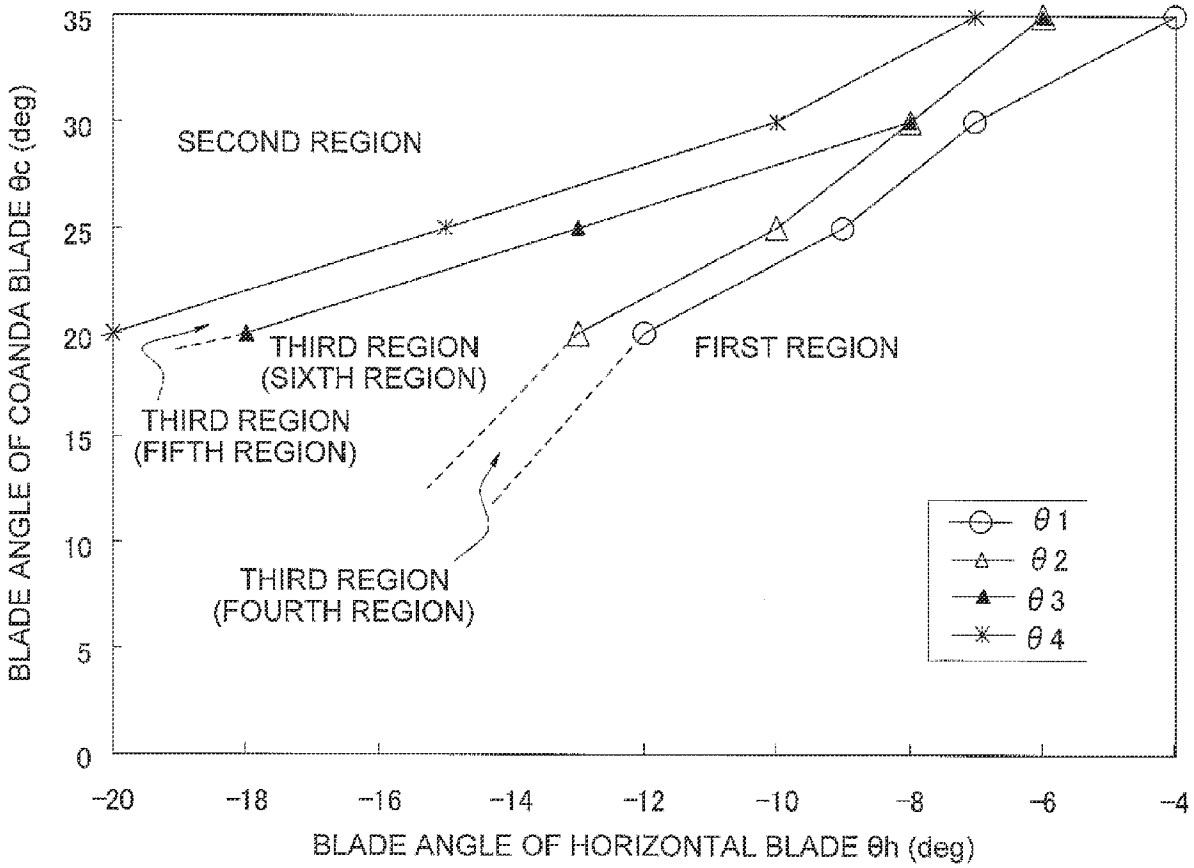
FIG. 5 is a drawing for describing the relationship between the outlet air and blade angles of a Coanda blade and a horizontal blade.
Figure 6:
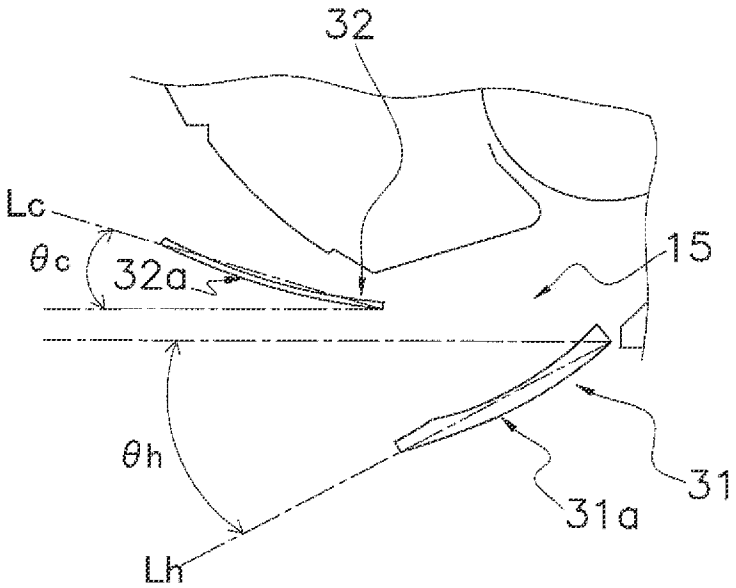
FIG. 6 is a drawing for describing the blade angle of the Coanda blade and the blade angle of the horizontal blade.

FIG. 5 is a drawing for describing the relationship between the outlet air and blade angle combinations of the Coanda blade 32 and the horizontal blade 31. In FIG. 5, θ1 represents a blade angle combination of the Coanda blade 32 and the horizontal blade 31 when there has been a transition from a third airflow state to a first airflow state described later, θ2 represents a blade angle combination of the Coanda blade 32 and the horizontal blade 31 when there has been a transition from the first airflow state to the third airflow state described later, θ3 represents a blade angle combination of the Coanda blade 32 and the horizontal blade 31 when there has been a transition from a second airflow state to the third airflow state described later, and θ4 represents a blade angle combination of the Coanda blade 32 and the horizontal blade 31 when there has been a transition from the third airflow state to the second airflow state described later. Furthermore, the blade angle θh of the horizontal blade 31 shown in FIG. 5 is, as shown in FIG. 6, an angle formed by a horizontal line and a straight line Lh joining the front and rear ends of the outside surface 31*a* of the horizontal blade 31. Additionally, the blade angle θc of the Coanda blade 32 shown in FIG. 5 is an angle formed by the horizontal line and a straight line Lc joining the front and rear ends of the outside surface 32*a* of the Coanda blade 32. Here, the blade angle θh and the blade angle θc are not absolute values and are negative values in a case where they become lower than the horizontal line. Additionally, the open angle (relative angle) θ between the horizontal blade 31 and the Coanda blade 32 can be given by the equation $\theta=\theta c-\theta h$.

Figure 7A:
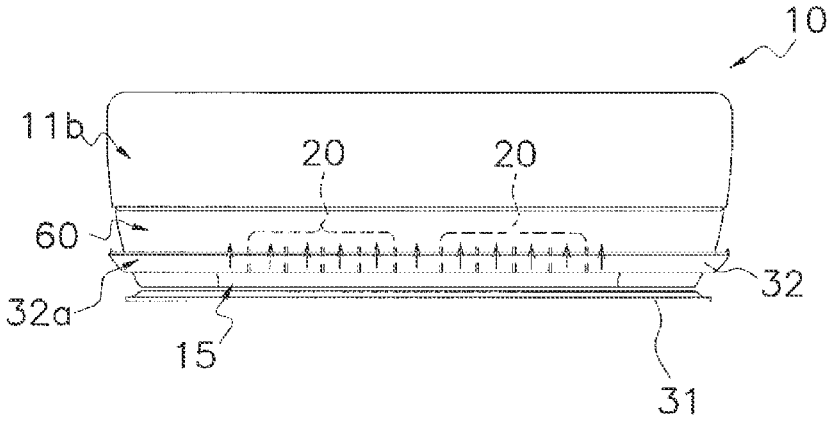
FIGS. 7(*a*) to 7(*c*) are views showing an example when a relative angle between the Coanda blade and the horizontal blade is in a predetermined angle in a first angular range, with FIG. 7(*a*) being a front view of the air conditioning indoor unit, FIG. 7(*b*) being a side view of the air conditioning indoor unit, and FIG. 7(*c*) being a schematic view showing a flow of the outlet air on an outside surface of the Coanda blade.
Figure 7B:
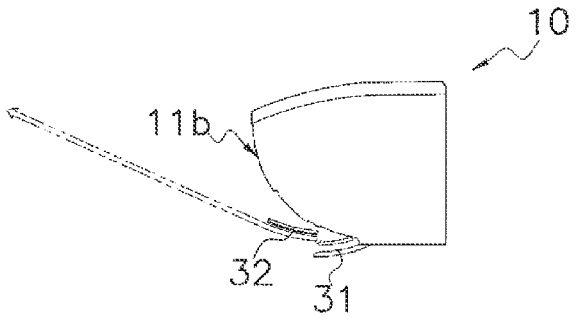
Figure 7C:
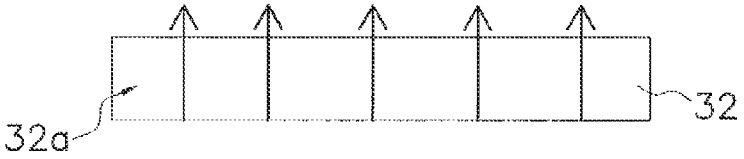
Figure 8A:
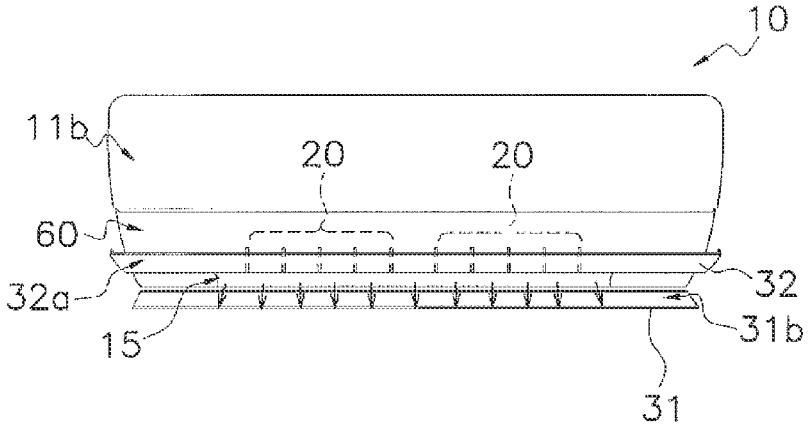
FIGS. 8(*a*) to 8(*c*) are views showing an example when the relative angle between the Coanda blade and the horizontal blade is in a predetermined angle in a second angular range, with FIG. 8(*a*) being a front view of the air conditioning indoor unit, FIG. 8(*b*) being a side view of the air conditioning indoor unit, and FIG. 8(*c*) being a schematic view showing a flow of the outlet air on the outside surface of the Coanda blade.
Figure 8B:
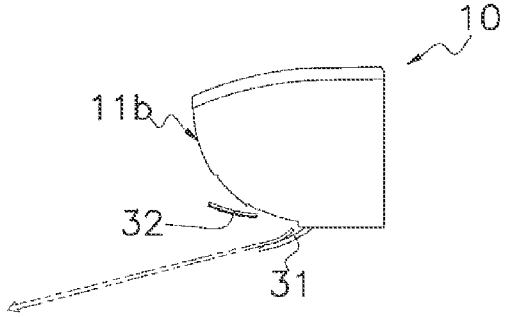
Figure 8C:
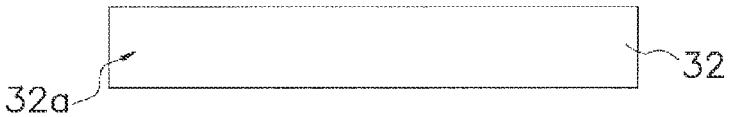
Figure 9A:
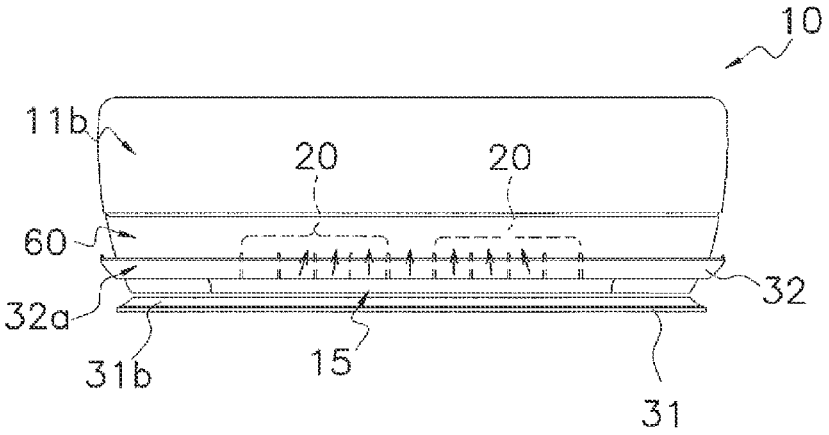
FIGS. 9(*a*) to 9(*c*) are views showing an example when the relative angle between the Coanda blade and the horizontal blade is in a predetermined angle in a third angular range, with FIG. 9(*a*) being a front view of the air conditioning indoor unit, FIG. 9(*b*) being a side view of the air conditioning indoor unit, and FIG. 9(*c*) being a schematic view showing a flow of the outlet air on the outside surface of the Coanda blade.
Figure 9B:
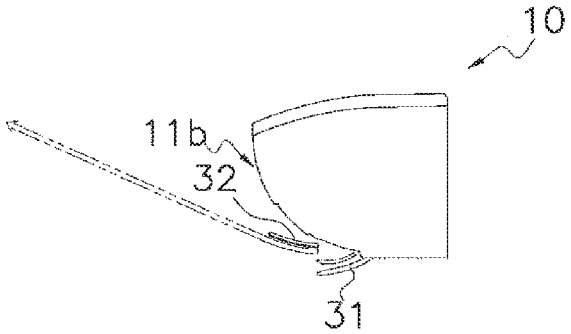
Figure 9C:
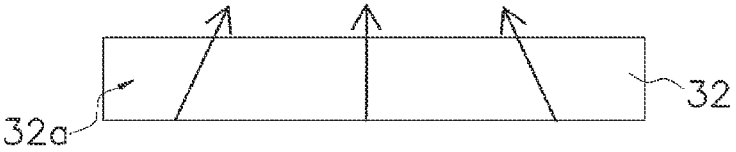

FIGS. 7(*a*) to 7(*c*), FIGS. 8(*a*) to 8(*c*), and FIGS. 9(*a*) to 9(*c*) are conceptual drawings showing flows of the outlet air when the blade angle combination of the Coanda blade 32 and the horizontal blade 31 is in each region shown in FIG. 5.

FIG. 5 shows the results of having performed the evaluation test by fixing the posture of the vertical blades 20 in a forward blowing posture in which the surfaces of the plural blade pieces 21 are positioned perpendicular to the lengthwise direction of the air outlet 15, fixing, without changing, the air volume of the indoor fan 14 at a predetermined air volume, and changing the blade angle (posture) of the horizontal blade 31 with respect to the Coanda blade 32.

When the blade angle combination of the Coanda blade 32 and the horizontal blade 31 was changed to change the relative angle between the Coanda blade 32 and the horizontal blade 31, there were transitions to three airflow states: a state in which, as shown in FIGS. 7(*a*) to 7(*c*), the Coanda airflow is produced on substantially the entire region of the outside surface 32*a* of the Coanda blade 32 (hereinafter called a first airflow state); a state in which, as shown in FIGS. 8(*a*) to 8(*c*), the Coanda airflow along the outside surface 32*a* of the Coanda blade 32 is not produced (hereinafter called a second airflow state); and a state in which, as shown in FIGS. 9(*a*) to 9(*c*), the Coanda airflow is produced on part of the outside surface 32*a* of the Coanda blade 32 (hereinafter called a third airflow state).

The state in which "the Coanda airflow is produced on substantially the entire region of the outside surface 32*a* of the Coanda blade 32" includes a state in which the outlet air is a flow attached to the entire region of the outside surface 32*a* of the Coanda blade 32 and a state in which, in a case where the lengthwise direction dimension of the Coanda blade 32 is longer than the lengthwise direction dimension of the air outlet 15 like in the present embodiment, for example, the outlet air is a flow attached to the entire region of the section of the outside surface 32*a* of the Coanda blade 32 that opposes the air outlet 15.

For example, when the blade angle θh of the horizontal blade 31 is set equal to or less than −15 degrees (so as to become farther away from 0 degrees) in a case where the blade angle θc of the Coanda blade 32 is fixed at 25 degrees, this results in the second airflow state. Furthermore, for example, when the blade angle θh of the horizontal blade 31 is set equal to or greater than −9 degrees (so as to become closer to 0 degrees) in a case where the blade angle θc of the Coanda blade 32 is fixed at 25 degrees, this results in the first airflow state. Moreover, when the blade angle θh of the horizontal blade 31 is set to −11 degrees or −12 degrees in a case where the blade angle θc of the Coanda blade 32 is fixed at 25 degrees, this results in the third airflow state.

From these results, as blade angle combinations of the Coanda blade 32 and the horizontal blade 31, it was understood that between a blade angle combination region that results in the first airflow state (a blade angle combination region in which the relative angle between the Coanda blade 32 and the horizontal blade 31 is smaller than the blade angle combination θ1 shown in FIG. 5; hereinafter called a first region) and a blade angle combination region that results in the second airflow state (a blade angle combination region in which the relative angle between the Coanda blade 32 and the horizontal blade 31 is greater than the blade angle combination θ4 shown in FIG. 5; hereinafter called a second region), there exists a blade angle combination region that results in the third airflow state (a blade angle combination region sandwiched between the blade angle combination θ1 and the blade angle combination θ4 shown in FIG. 5; hereinafter called a third region).

Additionally, because the relative angle between the Coanda blade 32 and the horizontal blade 31 when the blade angle combination of the Coanda blade 32 and the horizontal blade 31 is in a predetermined blade angle combination in the first region is smaller than the relative angle between the Coanda blade 32 and the horizontal blade 31 when the blade angle combination of the Coanda blade 32 and the horizontal blade 31 is in a predetermined blade angle combination in the third region, and because the relative angle between the Coanda blade 32 and the horizontal blade 31 when the blade angle combination of the Coanda blade 32 and the horizontal blade 31 is in a predetermined blade angle combination in the second region is larger than the relative angle between the Coanda blade 32 and the horizontal blade 31 when the blade angle combination of the Coanda blade 32 and the horizontal blade 31 is in a predetermined blade angle combination in the third region, it was found that as angular ranges of the relative angle between the Coanda blade 32 and the horizontal blade 31, between a first angular range that results in the first airflow state and a second angular range that results in the second airflow state there exists a third angular range that results in the third airflow state.

In a case where the Coanda blade and the horizontal blade are assuming predetermined postures in which the relative angle between the Coanda blade 32 and the horizontal blade 31 becomes a predetermined angle in the third angular range, in the Coanda airflow along the outside surface 32*a* of the Coanda blade 32, the airflows on both end portions of the outside surface 32*a* of the Coanda blade 32 are flows deflected toward the center (see FIG. 9(*c*)). That is, what is called the third airflow state here is a state in which the Coanda airflow is produced on the central portion (part) of the outside surface 32*a* of the Coanda blade 32 but the Coanda airflow is not produced on both end portions (other portions) of the outside surface 32*a* of the Coanda blade 32. It is thought that this is because air on the sides of the Coanda blade 32 is drawn by the dynamic pressure of the Coanda airflow into the Coanda airflow from both end portions of the Coanda blade 32, so that the airflows along both end portions of the Coanda blade 32 are pushed by air from the sides and become unstable airflows toward the central portion.

Moreover, for example, when the blade angle θh of the horizontal blade 31 is gradually increased (so as to become closer to 0 degrees) from −12 degrees in a state in which the blade angle θc of the Coanda blade 32 is fixed at 25 degrees, the airflow state is a switch from the third airflow state to the first airflow state when the blade angle θh of the horizontal blade 31 becomes −9 degrees. On the other hand, when the blade angle θh of the horizontal blade 31 is gradually decreased (so as to become farther away from 0 degrees) from −8 degrees in a state in which the blade angle θc of the Coanda blade 32 is fixed at 25 degrees, the airflow state is a switch from the first airflow state to the third airflow state when the blade angle θh of the horizontal blade 31 becomes −10 degrees.

Furthermore, for example, when the blade angle θh of the horizontal blade 31 is gradually increased (so as to become closer to 0 degrees) from −20 degrees in a state in which the blade angle θc of the Coanda blade 32 is fixed at 25 degrees, the airflow state is a switch from the second airflow state to the third airflow state when the blade angle θh of the horizontal blade 31 becomes −13 degrees. On the other hand, when the blade angle θh of the horizontal blade 31 is gradually decreased (so as to become farther away from 0 degrees) from −12 degrees in a state in which the blade angle θc of the Coanda blade 32 is fixed at 25 degrees, the airflow state is a switch from the third airflow state to the second airflow state when the blade angle θh of the horizontal blade 31 becomes −15 degrees.

From these results, it was understood that the relative angle of the blade angle combination θ1 when transitioning from the third airflow state to the first airflow state and the relative angle of the blade angle combination θ2 when transitioning from the first airflow state to the third airflow state are different. Moreover, it was understood that the relative angle of the blade angle combination θ4 when transitioning from the third airflow state to the second airflow state and the relative angle of the blade angle combination θ3 when transitioning from the second airflow state to the third airflow state are different.

That is, it was found that the angle when transitioning from the first airflow state to the third airflow state in a case where the relative angle between the Coanda blade 32 and the horizontal blade 31 has been gradually increased from a predetermined angle in the first angular range and the angle when transitioning from the third airflow state to the first airflow state in a case where the relative angle between the Coanda blade 32 and the horizontal blade 31 has been gradually decreased from a predetermined angle in the third angular range are different. Furthermore, it was found that the angle when transitioning from the second airflow state to the third airflow state in a case where the relative angle between the Coanda blade 32 and the horizontal blade 31 has been gradually decreased from a predetermined angle in the second angular range and the angle when transitioning from the third airflow state to the second airflow state in a case where the relative angle between the Coanda blade 32 and the horizontal blade 31 has been gradually increased from a predetermined angle in the third angular range are different.

From this, the present inventor discovered that in the blade angle combinations of the Coanda blade 32 and the horizontal blade 31, the blade angle combination region (hereinafter called a fourth region) between the blade angle combination θ1 when transitioning from the third airflow state to the first airflow state and the blade angle combination θ2 when transitioning from the first airflow state to the third airflow state and the blade angle combination region (hereinafter called a fifth region) between the blade angle combination θ4 when transitioning from the third airflow state to the second airflow state and the blade angle combination θ3 when transitioning from the second airflow state to the third airflow state are hysteresis regions. That is, the present inventor found that the third region includes the fourth region, the fifth region, and a blade angle combination region (hereinafter called a sixth region) between the blade angle combination θ2 and the blade angle combination θ3.

Therefore, the present inventor set the angular range of the relative angle between the Coanda blade 32 and the horizontal blade 31 when using the first airflow state to the first angular range and set the angular range of the relative angle between the Coanda blade 32 and the horizontal blade 31 when using the second airflow state to the second angular range. Moreover, the present inventor set the first angular range to an angular range excluding the third angular range and set an upper limit angle of the first angular range to the relative angle of the blade angle combination θ1. Furthermore, the present inventor set the second angular range to an angular range excluding the third angular range and set a lower limit angle of the second angular range to the relative angle of the blade angle combination θ4.

Additionally, as the postures of the Coanda blade 32 and the horizontal blade 31 employed in the Coanda airflow utilization mode using the first airflow state, the present inventor decided to employ predetermined postures in which the relative angle between the Coanda blade 32 and the horizontal blade 31 becomes a predetermined angle in the first angular range, and as the postures of the Coanda blade 32 and the horizontal blade 31 employed in the normal blowing mode using the second airflow state, the present inventor decided to employ predetermined postures in which the relative angle between the Coanda blade 32 and the horizontal blade 31 becomes a predetermined angle in the second angular range.

Because of this, in a case where the first airflow state is used, the relative angle between the Coanda blade 32 and the horizontal blade 31 is adjusted to the predetermined angle in the first angular range, and in a case where the second airflow state is used, the relative angle between the Coanda blade 32 and the horizontal blade 31 is adjusted to the predetermined angle in the second angular range, so by adjusting the relative angle between the Coanda blade 32 and the horizontal blade 31, the first airflow state and the second airflow state can be selectively used.

In order to more reliably produce the Coanda airflow on the entire region of the outside surface 32*a* of the Coanda blade 32 in the Coanda airflow utilization mode, it suffices to set the upper limit angle of the first angular range to an angle that is smaller than the relative angle of the blade angle combination θ1. Furthermore, in order to more reliably not produce the Coanda airflow on the outside surface 32*a* of the Coanda blade 32 in the normal blowing mode, it suffices to set the lower limit angle of the second angular range to an angle that is larger than the relative angle of the blade angle combination θ4.

(5) Characteristics (5-1)

The present inventor discovered that in an air conditioning indoor unit in which the Coanda blade 32 and the horizontal blade 31 cooperate with one another to change outlet air to a Coanda airflow along the undersurface of the Coanda blade 32, as angular ranges of the relative angle between the Coanda blade 32 and the horizontal blade 31, there exist a first angular range that results in a first airflow state in which the Coanda airflow is produced on substantially the entire region of the outside surface 32*a* of the Coanda blade 32 and a second angular range that is larger than the first angular range and results in a second airflow state in which the Coanda airflow along the outside surface 32*a* of the Coanda blade 32 is not produced.

Therefore, in the present embodiment, the control unit 40 adjusts the relative angle between the Coanda blade 32 and the horizontal blade 31 in order to selectively use either of the first airflow state and the second airflow state. More specifically, the control unit 40 adjusts the relative angle between the Coanda blade 32 and the horizontal blade 31 to the predetermined angle in the first angular range to use the first airflow state and adjusts the relative angle between the Coanda blade 32 and the horizontal blade 31 to the predetermined angle in the second angular range to use the second airflow state. Specifically, in the case of executing the Coanda airflow utilization mode using the first airflow state, the control unit 40 causes the Coanda blade 32 and the horizontal blade 31 to assume predetermined postures in which the relative angle between the Coanda blade 32 and the horizontal blade 31 becomes the predetermined angle in the first angular range. On the other hand, in the case of executing the normal blowing mode using the second airflow state, the control unit 40 causes the Coanda blade 32 and the horizontal blade 31 to assume predetermined postures in which the relative angle between the Coanda blade 32 and the horizontal blade 31 becomes the predetermined angle in the second angular range. In this way, by adjusting the relative angle between the Coanda blade 32 and the horizontal blade 31 to the predetermined angle in the first angular range or the second angular range, either of the first airflow state and the second airflow state can be selectively used.

Because of this, a stable airflow can be produced in both the Coanda airflow utilization mode using the first airflow state and the normal blowing mode using the second airflow state.

(5-2)

The present inventor discovered that as angular ranges of the relative angle between the Coanda blade 32 and the horizontal blade 31, between the first angular range that results in the first airflow state and the second angular range that results in the second airflow state there exists a third angular range that results in the third airflow state in which the Coanda airflow is produced on part of the outside surface 32*a* of the Coanda blade 32.

Therefore, in the present embodiment, the first angular range and the second angular range are set in angular ranges excluding the third angular range. For this reason, when the first airflow state that produces the Coanda airflow on substantially the entire region of the outside surface 32*a* of the Coanda blade 32 is used, the concern that the Coanda airflow will be produced only on part of the outside surface 32*a* of the Coanda blade 32 can be reduced. Furthermore, when the second airflow state that does not produce the Coanda airflow on the outside surface 32*a* of the Coanda blade 32 is used, the concern that the Coanda airflow will be produced on part of the outside surface 32*a* of the Coanda blade 32 can be reduced. As a result, a stable airflow can be produced no matter which of the first airflow state and the second airflow state is used.

Here, in a case which, in an air conditioning indoor unit in which either of the first airflow state and the second airflow state is selectively used, results in a predetermined airflow state other than the first airflow state and the second airflow state as a result of the relative angle between the Coanda blade and the horizontal blade becoming a predetermined angle in an angular range outside the first angular range and the second angular range when changing the relative angle between the Coanda blade and the horizontal blade from the predetermined angle in the first angular range to the predetermined angle in the second angular range or from the predetermined angle in the second angular range to the predetermined angle in the first angular range, the airflow state is allowed to transition to the second airflow state after having gone from the first airflow state to the predetermined airflow state and is allowed to transition to the first airflow state after having gone from the second airflow state to the predetermined airflow state.

Additionally, in the present embodiment, because the third angular range is an angular range between the first angular range and the second angular range, when changing the relative angle between the Coanda blade 32 and the horizontal blade 31 from the predetermined angle in the first angular range to the predetermined angle in the second angular range, the relative angle between the Coanda blade 32 and the horizontal blade 31 temporarily invariably becomes the predetermined angle in the third angular range, and when changing the relative angle between the Coanda blade 32 and the horizontal blade 31 from the predetermined angle in the second angular range to the predetermined angle in the first angular range, the relative angle between the Coanda blade 32 and the horizontal blade 31 temporarily invariably becomes the predetermined angle in the third angular range. For this reason, when switching from the first airflow state to the second airflow state and when switching from the second airflow state to the first airflow state, this momentarily results in the third airflow state.

(5-3)

In the present embodiment, the upper limit angle of the first angular range is set to the relative angle of the blade angle combination θ1 at which there is a transition from the third airflow state to the first airflow state in a case where the relative angle between the Coanda blade 32 and the horizontal blade 31 has been gradually increased from the predetermined angle in the second angular range. For this reason, in the Coanda airflow utilization mode in which the first airflow state is used, the concern that there will be a transition to the third airflow state can be reduced. Because of this, a stable Coanda airflow can be produced in the Coanda airflow utilization mode.

(5-4)

In the present embodiment, the lower limit angle of the second angular range is set to the relative angle of the blade angle combination θ4 at which there is a transition from the third airflow state to the second airflow state in a case where the relative angle between the Coanda blade 32 and the horizontal blade 31 has been gradually increased from the predetermined angle in the first angular range. For this reason, in the normal blowing mode in which the second airflow state is used, the concern that there will be a transition to the third airflow state can be reduced. Because of this, in the normal blowing mode, the concern that the Coanda airflow will be produced can be reduced.

(5-5)

In a case where, for example, the postures of the Coanda blade 32 and the horizontal blade 31 when the first airflow state is used are set to predetermined postures that result in a predetermined blade angle combination in the fourth region, or in other words in a case where the relative angle between the Coanda blade 32 and the horizontal blade 31 when the first airflow state is used is set in such a way as to become a predetermined angle in an angular range between the relative angle of the blade angle combination θ1 and the relative angle of the blade angle combination θ2—that is, an angular range (hereinafter called a fourth angular range) of the relative angle of the blade angle combination in the fourth region that is a hysteresis region—the potential for there to be a transition from the first airflow state to the third airflow state or a transition from the third airflow state to the first airflow state due to some kind of phenomenon (e.g., an airflow disturbance or the like) becomes higher.

Therefore, in the present embodiment, the fourth angular range is included in the third angular range, and the first angular range is set in an angular range excluding the third angular range. For this reason, when the first airflow state is being used, the concern that there will be a transition to the third airflow state can be reduced.

Because of this, a stable Coanda airflow can be produced in the Coanda airflow utilization mode.

(5-6)

In a case where, for example, the postures of the Coanda blade 32 and the horizontal blade 31 when the second airflow state is used are set to predetermined postures that become a predetermined blade angle combination in the fifth region, or in other words in a case where the relative angle between the Coanda blade 32 and the horizontal blade 31 when the second airflow state is being used is set in such a way as to become a predetermined angle in an angular range between the relative angle of the blade angle combination θ3 and the relative angle of the blade angle combination θ4—that is, an angular range (hereinafter called a fifth angular range) of the relative angle of the blade angle combination in the fifth region that is a hysteresis region—the potential for there to be a transition from the second airflow state to the third airflow state or a transition from the third airflow state to the second airflow state due to some kind of phenomenon (e.g., an airflow disturbance or the like) becomes higher.

Therefore, in the present embodiment, the fifth angular range is included in the third angular range, and the second angular range is set in an angular range excluding the third angular range. For this reason, when the second airflow state is being used, the concern that there will be a transition to the third airflow state can be reduced.

Because of this, it can be ensured that the Coanda airflow is not produced in the normal blowing mode.

(6) Example Modifications (6-1) Example Modification 1A

In a state in which the horizontal blade 31 is opening the air outlet 15, the outlet air blown out from the air outlet 15 flows generally along the inside surface 31*b* of the horizontal blade 31. Additionally, in a case where the inside surface 31*b* of the horizontal blade 31 is on the upper side of the tangent L0 to the terminal end F of the scroll surface 17, the outlet air blown out generally along the direction tangential to the terminal end F of the scroll surface 17 has its air direction changed upward by the horizontal blade 31. On the other hand, in a case where the inside surface 31*b* of the horizontal blade 31 is on the lower side of the tangent L0 to the terminal end F of the scroll surface 17, depending on the posture of the horizontal blade 31, sometimes the outlet air blown out generally along the direction tangential to the terminal end F of the scroll surface 17 does not have its air direction changed upward by the horizontal blade 31.

For this reason, in the air conditioning indoor unit 10 having a configuration in which the air direction of the outlet air is changed by the horizontal blade 31 and is further changed by the Coanda effect, when the inside surface 31*b* of the horizontal blade 31 is in a position on the lower side of the tangent L0 to the terminal end F, sometimes the Coanda airflow is not produced because the air direction of the outlet air cannot be changed (regulated) by the inside surface 31*b* of the horizontal blade 31 even if the Coanda blade 32 and the horizontal blade 31 have assumed predetermined postures in which the relative angle between the Coanda blade 32 and the horizontal blade 31 becomes the predetermined angle in the first angular range.

Therefore, in a case where the first airflow state is used, the outlet air can be regulated by the inside surface 31*b* of the horizontal blade 31 by causing the Coanda blade 32 and the horizontal blade 31 to assume postures in which the relative angle between the Coanda blade 32 and the horizontal blade 31 becomes the predetermined angle in the first angular range and in which the inside surface 31*b* of the horizontal blade 31 is in a position on an upper side of an imaginary extension line of the tangent L0 to the terminal end F, that is, an imaginary extension plane of the scroll surface 17. As a result, the outlet air can be regulated toward the outside surface 32*a* of the Coanda blade 32, so the concern that the Coanda airflow will not be produced in a case where the first airflow state is used can be reduced.

INDUSTRIAL APPLICABILITY

The present invention can produce a stable airflow in both an airflow state utilizing a Coanda airflow and an airflow state not utilizing a Coanda airflow by adjusting the relative angle between a Coanda blade and a horizontal blade, so the present invention is effectively applied to an air conditioning indoor unit that selectively uses an airflow state utilizing a Coanda airflow and an airflow state not utilizing a Coanda airflow.

What is claimed is:

1. An air conditioning indoor unit comprising:

a casing having an air outlet formed therein from which outlet air is blown out, and the casing having a front panel defining a front portion of the air conditioning indoor unit; a horizontal blade arranged and configured to change an up and down direction flow of the outlet air by a regulating surface;

a Coanda blade that utilizes the Coanda effect, which is a phenomenon in which the outlet air tends to flow in. a direction along an undersurface positioned in a direction out of and different from a flow direction of the outlet air, to change the outlet air between the undersurface of the Coanda blade and the regulating surface of the horizontal blade, of which air direction has been changed by the regulating surface of the horizontal blade, to a Coanda airflow along the undersurface of the Coanda blade; and a control unit configured to control a motor coupled to the Coanda blade and a motor coupled to the horizontal blade so as to adjust a relative angle between the Coanda blade and the horizontal blade in such a way as to selectively position the blades according to selection of the airflow states, the airflow states including a first airflow state, in which the control unit adjusts the relative angle to a predetermined angle in a first angular range to produce the Coanda airflow on substantially an entire region of the undersurface of the Coanda blade, and a second airflow state, in which the control unit adjusts the relative angle to a predetermined angle in a second angular range larger than the first angular range to not produce the Coanda airflow, a height position of a lower end portion of the Coanda blade becoming lower as an upper end portion of the Coanda blade moves away from the front panel of the casing.

2. The air conditioning indoor unit according to claim 1, wherein when the control unit adjusts the relative angle to a predetermined angle in a third angular range, a third airflow state results in which the Coanda airflow is produced on part of the undersurface of the Coanda blade, and the first angular range and the second angular range are set in such a way as to exclude the third angular range.

3. The air conditioning indoor unit according to claim 2, wherein an upper limit angle of the first angular range is set to an angle equal to or less than an angle at which there is a transition from the third airflow state to the first airflow state when the relative angle has been gradually decreased from a predetermined angle in the second angular range.

4. The air conditioning indoor unit according to claim 2, wherein a lower limit angle of the second angular range is set to an angle equal to or greater than an angle at which there is a transition from the third airflow state to the second airflow state when the relative angle has been gradually increased from a predetermined angle in the first angular range.

5. The air conditioning indoor unit according to claim 2, wherein an angle at which there is a transition from the first airflow state to the third airflow state when the relative angle has been gradually increased from a predetermined angle in the first angular range and an angle at which there is a transition from the third airflow state to the first airflow state when the relative angle has been gradually decreased from a predetermined angle in the third angular range are different.

6. The air conditioning indoor unit according to claim 2, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

7. The air conditioning indoor unit according to claim 1, further comprising a fan disposed inside the casing and arranged and configured to form an airflow in which air taken into the casing is channeled toward the air outlet, the Coanda airflow being produced as a result of the outlet air being regulated by a regulating surface of the horizontal blade and thereafter flowing along the undersurface of the Coanda blade, the casing including a scroll surface that extends from a back side of the fan to the air outlet and forms a lower portion of an outlet air flow path, and in a case where the first airflow state is used, the regulating surface of the horizontal blade is set in such a way as to be in a position on an upper side of an imaginary extension plane of the scroll surface.

8. The air conditioning indoor unit according to claim 3, wherein a lower limit angle of the second angular range is set to an angle equal to or greater than an angle at which there is a transition from the third airflow state to the second airflow state when the relative angle has been gradually increased from a predetermined angle in the first angular range.

9. The air conditioning indoor unit according to claim 8, wherein an angle at which there is a transition from the first airflow state to the third airflow state when the relative angle has been gradually increased from a predetermined angle in the first angular range and an angle at which there is a transition from the third airflow state to the first airflow state when the relative angle has been gradually decreased from a predetermined angle in the third angular range are different.

10. The air conditioning indoor unit according to claim 8, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

11. The air conditioning indoor unit according to claim 3, wherein an angle at which there is a transition from the first airflow state to the third airflow state when the relative angle has been gradually increased from a predetermined angle in the first angular range and an angle at which there is a transition from the third airflow state to the first airflow state when the relative angle has been gradually decreased from a predetermined angle in the third angular range are different.

12. The air conditioning indoor unit according to claim 11, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

13. The air conditioning indoor unit according to claim 3, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

14. The air conditioning indoor unit according to claim 4, wherein an angle at which there is a transition from the first airflow state to the third airflow state when the relative angle has been gradually increased from a predetermined angle in the first angular range and an angle at which there is a transition from the third airflow state to the first airflow state when the relative angle has been gradually decreased from a predetermined angle in the third angular range are different.

15. The air conditioning indoor unit according to claim 4, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

16. The air conditioning indoor unit according to claim 5, wherein an angle at which there is a transition from the second airflow state to the third airflow state when the relative angle has been gradually decreased from a predetermined angle in the second angular range and an angle at which there is a transition from the third airflow state to the second airflow state when the relative angle has been gradually increased from a predetermined angle in the third angular range are different.

* * * * *

UNITED STATES PATENT AND TRADEMARK OFFICE

CERTIFICATE OF CORRECTION

PATENT NO. : 9,494,329 B2
APPLICATION NO. : 14/367117
DATED : November 15, 2016
INVENTOR(S) : Masanao Yasutomi It is certified that error appears in the above-identified patent and that said Letters Patent is hereby corrected as shown below:

On the Title Page

"(87) PCT Pub. No.: WO2013/099914
PCT Pub. Date: Apr. 7, 2013"

Should read:
-- (87) PCT Pub. No.: WO2013/099914
PCT Pub. Date: July 4, 2013 --

In the Claims

Claim 1 in Column 20, Line 4:
"phenomenon in which the outlet air tends to flow in. a"

Should read:
-- phenomenon in which the outlet air tends to flow in a --

Signed and Sealed this
Sixth Day of June, 2017

Michelle K. Lee

Michelle K. Lee
*Director of the United States Patent and Trademark Office*